US009091956B2

(12) United States Patent
Zaima et al.

(10) Patent No.: US 9,091,956 B2
(45) Date of Patent: Jul. 28, 2015

(54) IMAGE FORMING APPARATUS FOR PERFORMING EXPOSURE A PLURALITY OF TIMES

(71) Applicant: CANON KABUSHIKI KAISHA, Tokyo (JP)

(72) Inventors: Nobuhiko Zaima, Kashiwa (JP); Tomohisa Itagaki, Abiko (JP); Takahiro Ishihara, Maebashi (JP); Yasuhito Shirafuji, Kashiwa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/469,393

(22) Filed: Aug. 26, 2014

(65) Prior Publication Data

US 2014/0363183 A1 Dec. 11, 2014

Related U.S. Application Data

(63) Continuation of application No. 13/755,977, filed on Jan. 31, 2013, now Pat. No. 8,854,408.

(30) Foreign Application Priority Data

Feb. 10, 2012 (JP) ..... 2012-027723

(51) Int. Cl.
*G03G 15/04* (2006.01)
*G03G 15/00* (2006.01)
(Continued)

(52) U.S. Cl.
CPC ..... *G03G 15/043* (2013.01); *G03G 13/04* (2013.01); *G03G 15/5025* (2013.01)

(58) Field of Classification Search
CPC ... G03G 15/5025; G03G 15/04; G03G 13/04; G03G 13/043
USPC ..... 347/224, 240, 251, 253
See application file for complete search history.

(56) References Cited

U.S. PATENT DOCUMENTS 4,916,530 A 4/1990 Neilson et al. ..... 347/238
5,983,045 A 11/1999 Suzuki et al. ..... 399/51
(Continued)

FOREIGN PATENT DOCUMENTS

CN 101039373 9/2007
JP 05-294005 11/1993
(Continued)

OTHER PUBLICATIONS

Great Britain Search Report dated Aug. 9, 2013 in counterpart Great Britain Patent Application No. 1302275.1.
(Continued)

*Primary Examiner* — Sarah Al Hashimi
(74) *Attorney, Agent, or Firm* — Fitzpatrick, Cella, Harper & Scinto

(57) ABSTRACT

An image forming apparatus includes; an exposure unit configured to perform, based on the image data, first exposure for a photosensitive member and second exposure for the photosensitive member exposed by the first exposure; a determination unit configured to determine a type of the image to be formed based on image data; and a control unit configured to control the exposure unit such that a difference in an exposure amount between the first exposure and the second exposure performed based on the image data when the type of the image is a character is larger than the difference in the exposure amount between the first exposure and the second exposure performed based on the image data when the type of the image is a picture.

6 Claims, 13 Drawing Sheets

(51) Int. Cl.
*G03G 13/04* (2006.01)
*G03G 15/043* (2006.01)

(56) References Cited

U.S. PATENT DOCUMENTS

| | | | | |
|---|---|---|---|---|
| 6,717,604 | B2 | 4/2004 | Nagumo | 347/237 |
| 2001/0043815 | A1 | 11/2001 | Kitajima et al. | 399/44 |
| 2004/0056945 | A1 | 3/2004 | Takamatsu et al. | 347/237 |
| 2004/0223174 | A1 | 11/2004 | Mikami | 358/1.9 |
| 2007/0216953 | A1 | 9/2007 | Kikuchi et al. | 358/3.06 |
| 2008/0292343 | A1 | 11/2008 | Gomi et al. | 399/561 |
| 2009/0003892 | A1 | 1/2009 | Sakaizawa et al. | 399/284 |
| 2009/0097874 | A1 | 4/2009 | Yamamoto | 399/74 |
| 2009/0154946 | A1 | 6/2009 | Nakase | 399/52 |
| 2013/0208069 | A1 * | 8/2013 | Zaima et al. | 347/118 |

FOREIGN PATENT DOCUMENTS

| | | |
|---|---|---|
| JP | 10-142881 | 5/1998 |
| JP | 11-13890 | 5/1999 |
| JP | 11-138904 | 5/1999 |
| JP | 2001-281940 | 10/2001 |
| JP | 2004-109680 | 4/2004 |
| JP | 2004-230846 | 8/2004 |
| JP | 2004-287069 | 10/2004 |
| JP | 2012-003181 | 1/2012 |

OTHER PUBLICATIONS

Chinese Office Action dated Jan. 21, 2015 in counterpart Chinese Patent Application No. 201310050040.2 together with an English language translation.

* cited by examiner

IMAGE FORMING APPARATUS FOR PERFORMING EXPOSURE A PLURALITY OF TIMES

This application is a continuation of U.S. application Ser. No. 13/755,977, filed Jan. 31, 2013 (currently pending), and claims the benefit of priority under 35 U.S.C. §119, based on Japanese Priority Application No. 2012-027723, filed Feb. 10, 2012, each of which are incorporated by reference herein in their entirety, as if fully set forth herein.

BACKGROUND OF THE INVENTION

1. Field of the Invention

The present invention relates to an image forming apparatus such as a printer or a copying machine which performs image formation using electrophotographic method or the like.

2. Description of the Related Art

Japanese Patent Laid-Open No. 5-294005 discloses an image forming apparatus that scans a photosensitive member at once by a plurality of light beams using a VCSEL (Vertical Cavity Surface Emitting Laser) including a plurality of light sources to speed up image formation.

In the image forming apparatus that scans using a plurality of light beams, stripes are generated in the scan direction in which the light beams scan the photosensitive member due to the variation between the elements or the nonuniform scan line intervals. To suppress the degradation in image quality, Japanese Patent Laid-Open No. 2004-109680 discloses an image forming apparatus that performs so-called multiple exposure in which the surface of a photosensitive member is exposed a plurality of times based on the same image data.

The multiple exposure makes it possible to suppress the degradation in image quality caused when the photosensitive member is scanned by a plurality of light beams. However, since the spot position of overlaid light beams may shift, the latent image may blur, and the image sharpness may lower. This leads to degradation in quality of a character image which particularly needs to be reproduced sharply.

SUMMARY OF THE INVENTION

The present invention provides an image forming apparatus for performing multiple exposure, which solves the above-described problem, and maintains the quality of a formed image.

According to an aspect of the present invention, an image forming apparatus for forming an image based on image data, includes: a photosensitive member; an exposure unit configured to perform, based on the image data, first exposure for the photosensitive member and second exposure for the photosensitive member exposed by the first exposure; a determination unit configured to determine a type of the image to be formed based on the image data; and a control unit configured to control the exposure unit such that a difference in an exposure amount between the first exposure and the second exposure performed based on the image data when the determination unit determines that the type of the image is a character is larger than the difference in the exposure amount between the first exposure and the second exposure performed based on the image data when the determination unit determines that the type of the image is a picture.

Further features of the present invention will become apparent from the following description of exemplary embodiments with reference to the attached drawings.

DESCRIPTION OF THE EMBODIMENTS

First Embodiment

Figure 1A:
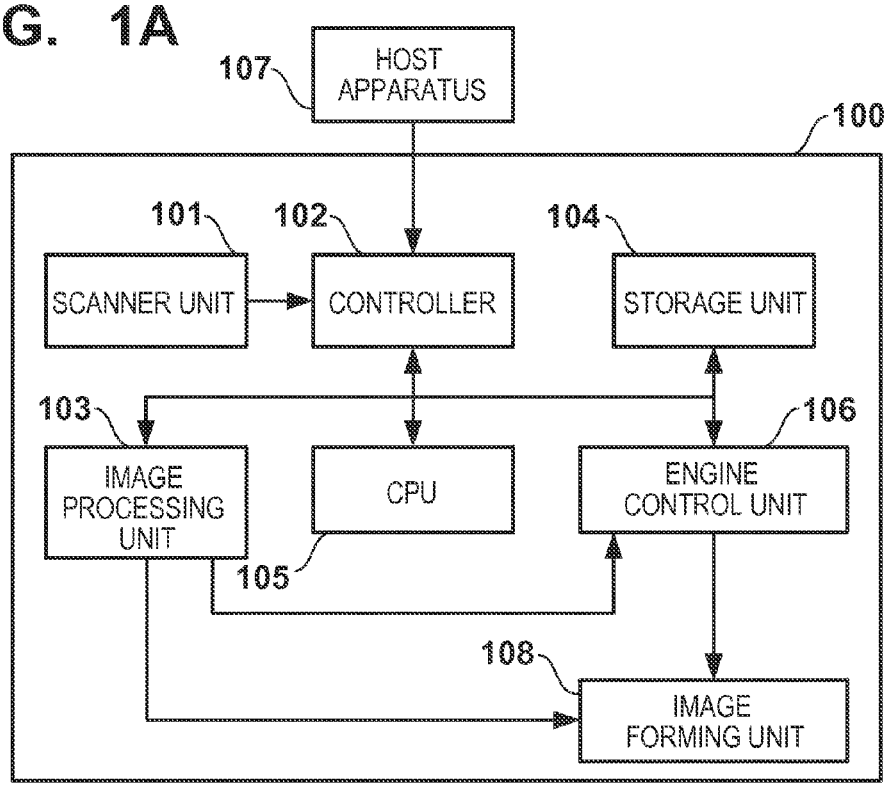
FIGS. 1A and 1B are block diagrams of an image forming apparatus according to an embodiment.

The first embodiment of the present invention will now be described. Note that for the sake of simplicity, constituent elements unnecessary for understanding of the embodiment are not illustrated in the drawings to be described below.

Figure 1B:
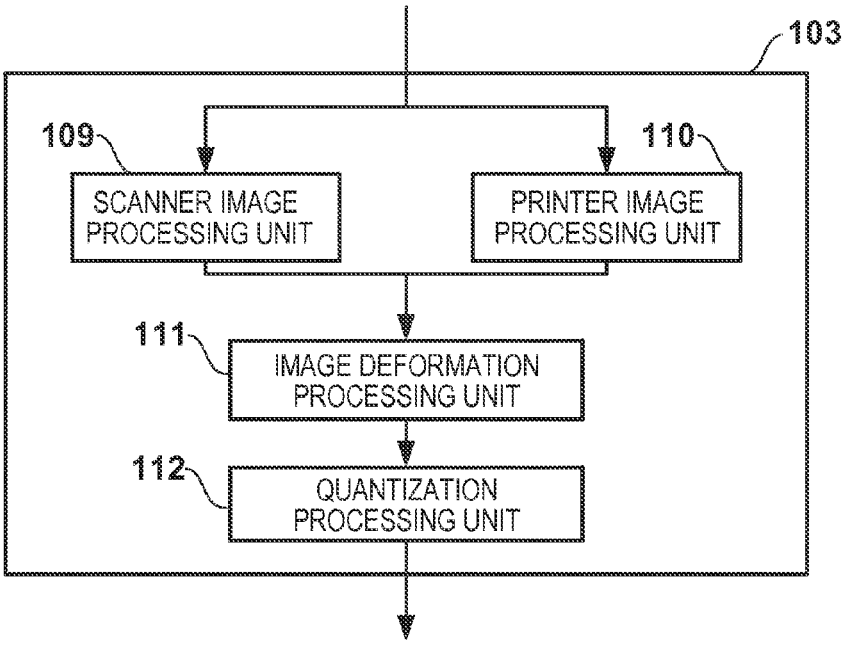

FIG. 1A is a block diagram of an image forming apparatus 100 according to this embodiment, and FIG. 1B is a block diagram of an image processing unit 103. The image forming apparatus 100 includes a scanner unit 101. Upon acquiring image data read by the scanner unit 101, a controller 102 outputs the image data to a scanner image processing unit 109 of the image processing unit 103 shown in FIG. 1B. The scanner image processing unit 109 performs predetermined image processing such as shading correction, region segmentation, and color conversion for the input image data.

Upon receiving PDL (Page Description Language) data from a host apparatus 107 such as a computer, the controller 102 outputs the data to a printer image processing unit 110 of the image processing unit 103 shown in FIG. 1B. The printer image processing unit 110 interprets commands included in the input PDL data and outputs an intermediate code. The printer image processing unit 110 also converts (rasterizes) the intermediate code into a bitmap image using an internal RIP (Raster Image Processor). The printer image processing unit 110 also generates attribute information based on the attributes of the commands included in the PDL data.

In general, PDL data is described by (A) character code (text), (B) graphic code (graphic), and (C) raster image data (bitmap image: to be simply referred to as an image hereinafter). In this embodiment, the printer image processing unit 110 generates attribute information representing the attributes of the respective portions of the image using the three attributes "text", "graphic", and "image" in accordance with the description.

Additionally, in this embodiment, the type of image portions where the attribute information is "text" is defined as "character" (first type), and the type of remaining image portions is defined as "halftone (picture)" (second type). That is, the type of a character image portion mainly including characters is defined as "character", and the type of a graphic image portion or a halftone image portion formed from tones is defined as "halftone". Note that an image portion whose type is "character" will simply be referred to as a character image, and an image portion whose type is "halftone" will simply be referred to as a halftone image (picture image) hereinafter. The scanner image processing unit 109 can add attribute information to each image portion obtained as the result of region segmentation. That is, the scanner image processing unit 109 determines the type of each image portion and adds attribute information. Hence, the image processing unit 103 also serves as a determination unit that determines the type of an image, or determines, for each pixel data of an image, whether the data is of a pixel of a character image or a pixel of a halftone image.

Note that the image processing unit 103 may determine the image type based on an image forming mode set by the user on the host apparatus 107. For example, assume that the image forming apparatus can set a character image forming mode and a picture image forming mode. When the user sets the character image forming mode on the host apparatus 107, the image processing unit 103 determines the image type as "character image" even if a PDL to determine the image type as "picture image" is received. On the other hand, when the user sets the picture image forming mode on the host apparatus 107, the image processing unit 103 determines the image type as "picture image" even if a PDL to determine the image type as "character image" is received.

An image deformation processing unit 111 performs processing such as toner reduction for the image data input from the scanner image processing unit 109 or the printer image processing unit 110. A quantization processing unit 112 performs dither processing and the like and outputs the processed image data to an image forming unit 108.

A storage unit 104 includes a RAM, a ROM, and the like. A CPU 105 executes various kinds of processing in accordance with programs saved in the storage unit 104. An engine control unit 106 controls image formation processing of the image forming unit 108.

Figure 2:
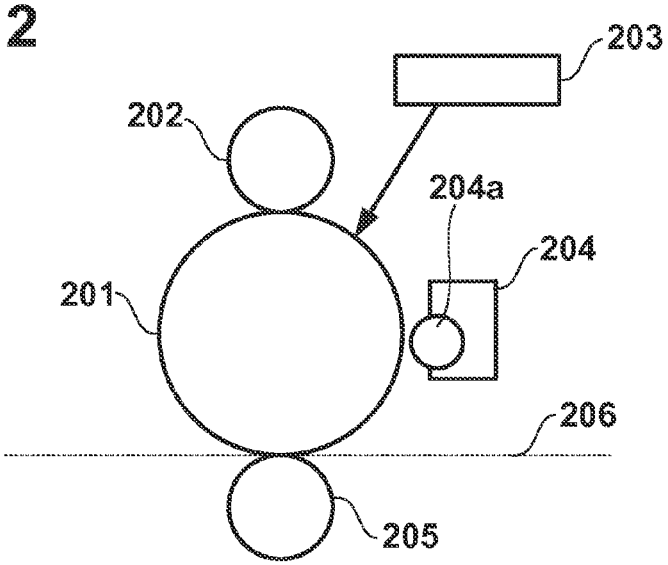
FIG. 2 is a view showing the schematic arrangement of an image forming unit according to an embodiment.

FIG. 2 is a view showing the schematic arrangement of the image forming unit 108. A charging unit 202 uniformly charges the surface of a photosensitive member 201 (photosensitive drum) to about −800 V (dark potential: Vd). An exposure unit 203 scans, on the photosensitive member 201, a light beam (laser beam) from a light source controlled based on the image data from the image processing unit 103, thereby forming an electrostatic latent image on the photosensitive member 201. Note that the potential (bright potential: VL) of the region of the photosensitive member irradiated with the light beam is, for example, about −200 V. Note that the difference between the dark potential Vd and the bright potential VL will be referred to as a latent image contrast potential. A developing unit 204 has a two-component developing material mainly containing a toner and a carrier, and develops the electrostatic latent image on the photosensitive member 201 into a toner image using the toner. Note that a developing bias of, for example, −500 V is applied from a power supply (not shown) to a developing sleeve 204*a*. The latent image contrast potential and developing bias settings are controlled based on a reference density. Since the charge amount of frictional electrification of the developing material depends on the water content in the atmosphere, the latent image contrast potential and developing bias settings change depending on the detected value of an ambient sensor (not shown). A transfer unit 205 transfers the toner image on the photosensitive member 201 to a printing material conveyed through a conveyance path 206. The printing material with the transferred toner image is then conveyed to a fixing unit (not shown), and the toner image is fixed.

Figure 3:
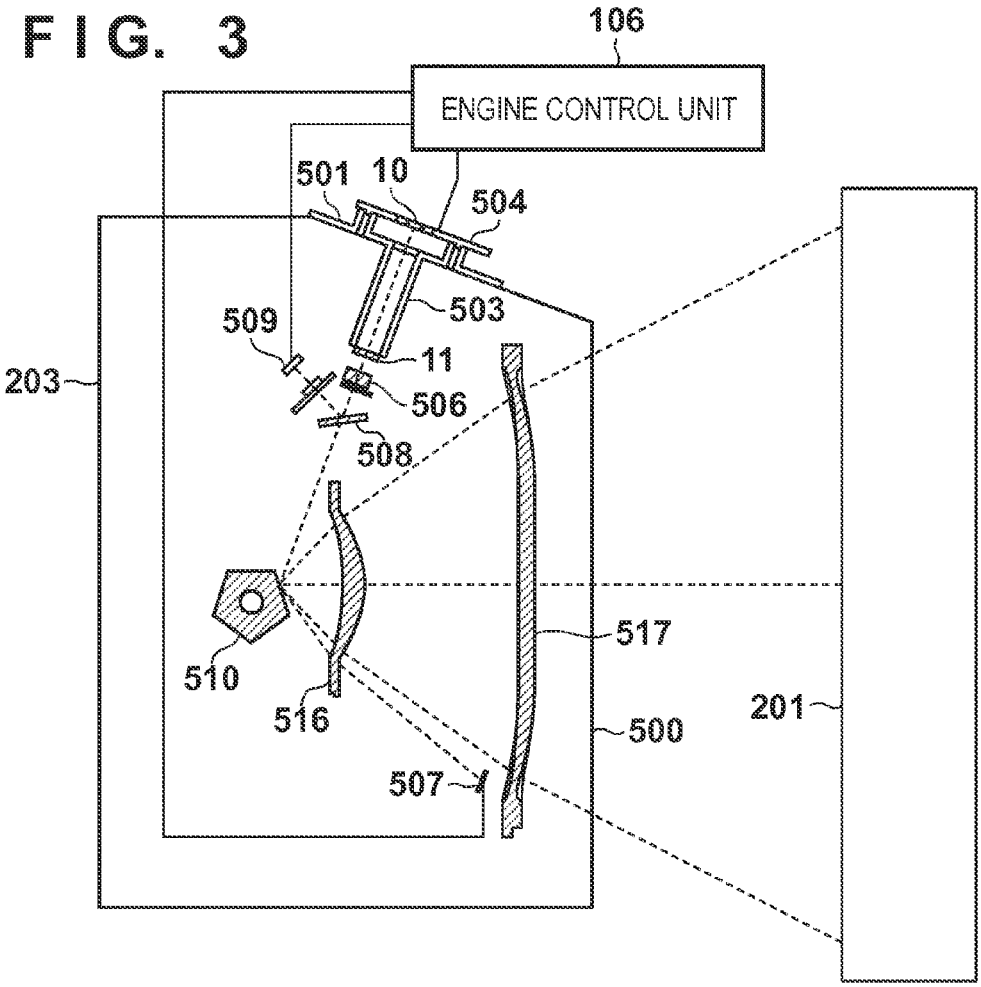
FIG. 3 is a view showing the arrangement of an exposure unit according to an embodiment.

The arrangement of the exposure unit 203 (optical scanning apparatus) will be described next with reference to FIG. 3. Note that the exposure unit 203 includes a housing 500. Various optical members to be described below are arranged in the housing 500. The exposure unit 203 is provided with a semiconductor laser serving as a light source unit 10 that emits a light beam (laser beam). The semiconductor laser is, for example, a VCSEL (Vertical Cavity Surface Emitting Laser). The light source unit 10 will be explained as the VCSEL 10 hereinafter. The VCSEL 10 is attached to a laser holder 501 (holding member) together with a collimator lens 11 to be described later. The laser holder 501 includes a lens barrel unit 503. The collimator lens 11 is attached to the distal end of the lens barrel unit 503. The collimator lens 11 converts the laser beam (divergent rays) emitted by the VCSEL 10 into a collimated light beam. The installation position of the collimator lens 11 is adjusted while detecting the irradiation position and focus of the laser beam emitted by the VCSEL 10 using a specific jig at the time of assembling the exposure unit 203. When the installation position of the collimator lens 11 is decided, a UV curing adhesive applied between the collimator lens 11 and the lens barrel unit 503 is irradiated with UV rays, thereby bonding the collimator lens 11 to the laser holder 501.

The VCSEL 10 is electrically connected to an electric circuit board 504 (to be referred to as a board 504 hereinafter). The VCSEL 10 emits a laser beam in accordance with a driving signal supplied from the board 504. A fitting hole to position the laser holder 501 is formed in a side wall of the housing 500. The lens barrel unit 503 of the laser holder 501 is fitted in the fitting hole, thereby positioning the laser holder 501 with respect to the housing 500. To adjust the image formation interval between a plurality of laser beams in the photosensitive member rotational direction (the image formation interval between laser beams in the sub-scanning direction), the laser holder 501 can finely be rotated while being fitted in the housing 500.

The laser beam that has passed through the collimator lens 11 passes through a cylindrical lens 506 and enters a polygon mirror 510 (rotating polygon mirror) that guides the laser beam to the photosensitive member serving as an irradiation target. The polygon mirror 510 is rotationally driven by a motor (not shown) at a predetermined speed. The laser beam that has entered the polygon mirror 510 is deflected by the reflecting surface and converted into scan light that moves on the photosensitive member 201 in a predetermined direction. The scan light is converted by imaging lenses 516 and 517 that are fθ lenses into scan light that scans the surface of the photosensitive member 201 at a uniform velocity.

The exposure unit 203 includes a BD sensor 507 for synchronous detection. The BD sensor 507 is arranged on the moving path of the scan light scanned by the polygon mirror 510. The BD sensor 507 receives the laser beam, thereby generating a synchronization signal. Based on the generation timing of the synchronization signal, the engine control unit 106 performs APC (Auto Power Control) of the laser beam and laser beam emission control based on the image data. In the exposure unit 203 of this embodiment, the laser beam that has passed through the collimator lens 11 enters a beam splitter 508 such as a half mirror for separating the laser beam. The beam splitter 508 separates the laser beam that has entered into transmitted light beam (transmitted laser beam) toward the polygon mirror 510 and reflected light beam (reflected laser beam) toward a PD 509 serving as a light-receiving element. The PD 509 that has received the reflected light beam outputs a voltage signal corresponding to the received light power. Note that the beam splitter 508 is a flat beam splitter in which the surface to receive a light beam and the surface to output a light beam are parallel.

The engine control unit 106 compares the voltage of the signal output from the PD 509 with the voltage corresponding to the target light power and controls, based on the voltage difference, the current value supplied from the board 504 to the VCSEL 10. More specifically, when the voltage of the signal output from the PD 509 is lower than the voltage corresponding to the target light power, the current supplied from the board 504 to the VCSEL 10 is increased to increase the light power of the light beam. On the other hand, when the voltage of the signal output from the PD 509 is higher than the voltage corresponding to the target light power, the current supplied from the board 504 to the VCSEL 10 is decreased to decrease the light power of the light beam. This is the auto power control executed by the engine control unit 106.

Figure 4:
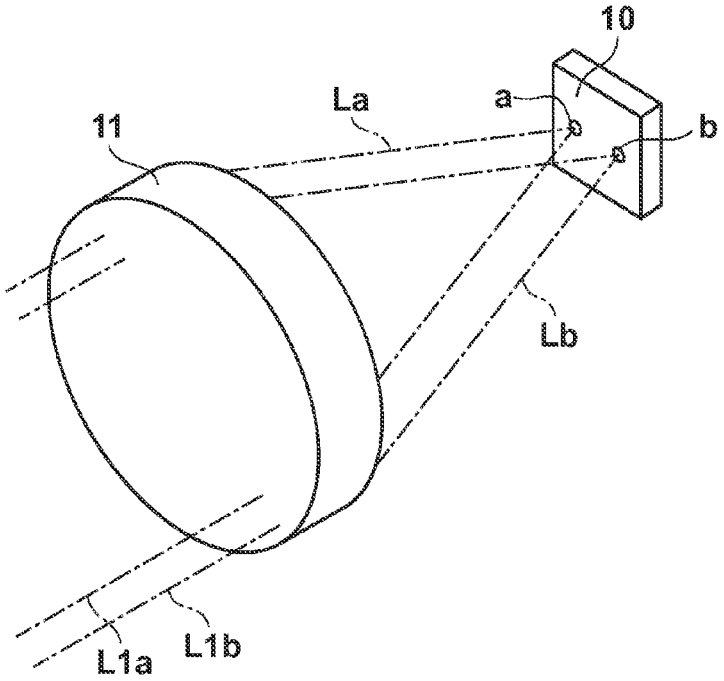
FIG. 4 is a view showing the arrangement of part of the exposure unit according to an embodiment.

FIG. 4 shows details of conversion to a collimated light beam by the collimator lens 11. Note that in FIG. 4, the light source unit 10 is assumed to have two light sources a and b for the sake of simplicity. As shown in FIG. 4, the light sources a and b of the light source unit 10 emit light beams La and Lb that are divergent rays, respectively. The collimator lens 11 converts the divergent rays La and Lb into collimated light beams L1a and L1b, respectively.

Figure 5:
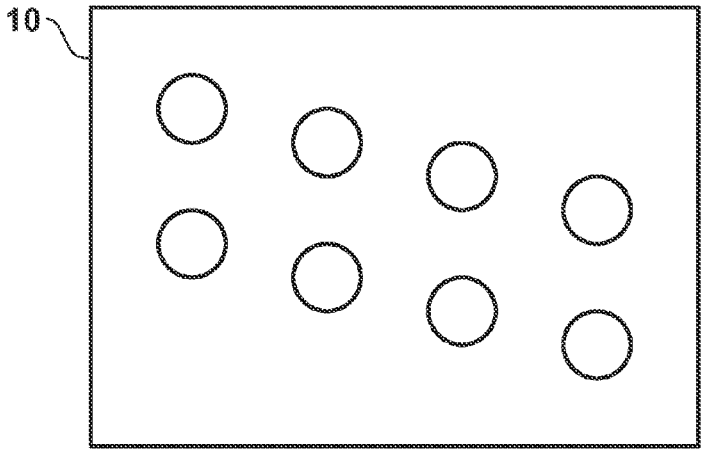
FIG. 5 is a view showing a light source unit according to an embodiment.
Figure 6:
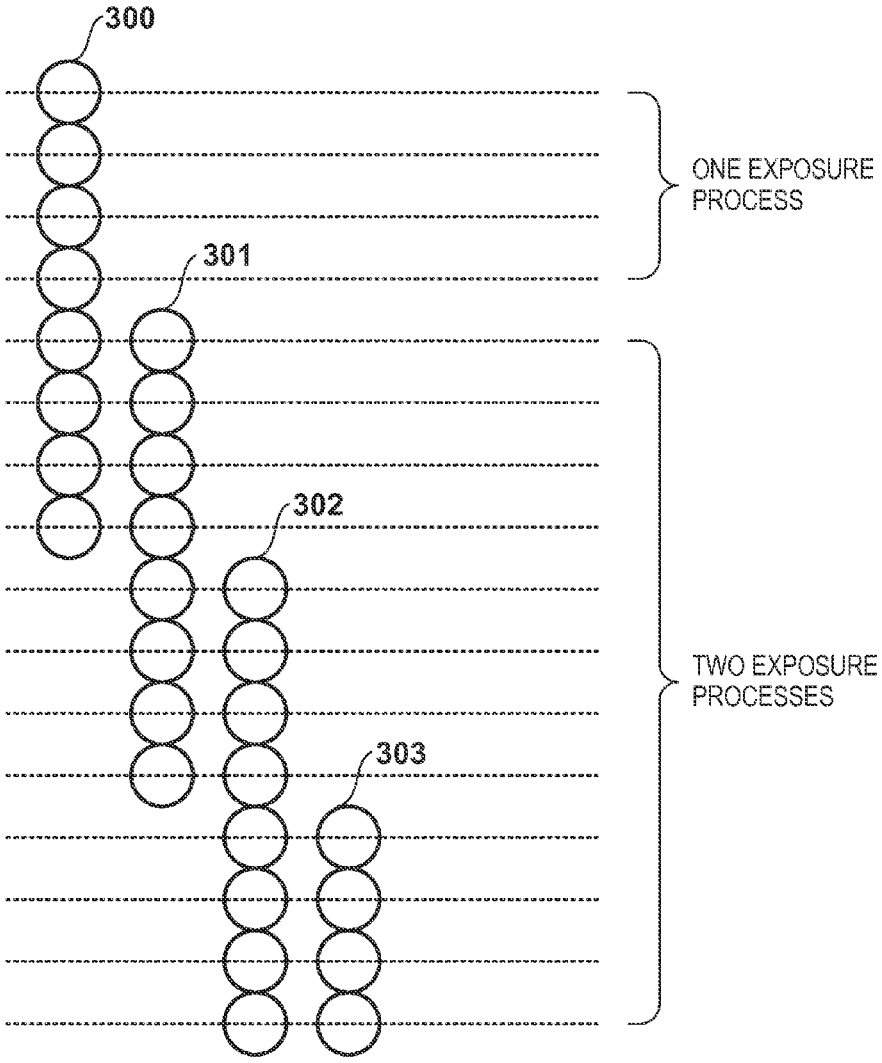
FIG. 6 is an explanatory view of multiple exposure according to an embodiment.

FIG. 5 shows an exemplary form of the light source unit 10. Referring to FIG. 5, eight light sources are arranged in a 4×2 array. Eight light beams generated by the eight light sources simultaneously scan the photosensitive member 201. That is, eight scan lines are simultaneously scanned. In this embodiment, when one scan in the main direction is completed, the scan position is moved by a distance corresponding to four scan lines in the sub-scanning direction, and the next scan is performed. More specifically, scan is performed first by eight light beams indicated by reference numeral 300 in FIG. 6. The next scan is performed at a position 301. Similarly, reference numerals 302 and 303 indicate the scan positions of the light beams in the third and fourth scan. The respective scan lines except the four scan lines of the first scan are scanned and exposed twice, thereby forming the pixels. Note that when light emission of the four light sources on the upper side in FIG. 6 out of the eight light sources is prohibited in the first scan, all scan lines are scanned twice.

Note that in this embodiment, the moving amount in the subs-scanning direction corresponds to four scan lines. This is merely an example. More generally, the scan position can be moved in the sub-scanning direction by a width corresponding to a fraction of an integer out of the number of scan lines that can be scanned simultaneously. For example, if scan is performed by moving the scan position by a distance corresponding to two scan lines, the respective scan lines are exposed four times. Exposing a single scan line N times (N is an integer equal to or larger than 2) makes it possible to average the variation in the position and characteristic of the light sources and also the influence of the variation in the scan interval on the electrostatic latent image and reduce the stripes and unevenness in the output image.

Figure 7A:
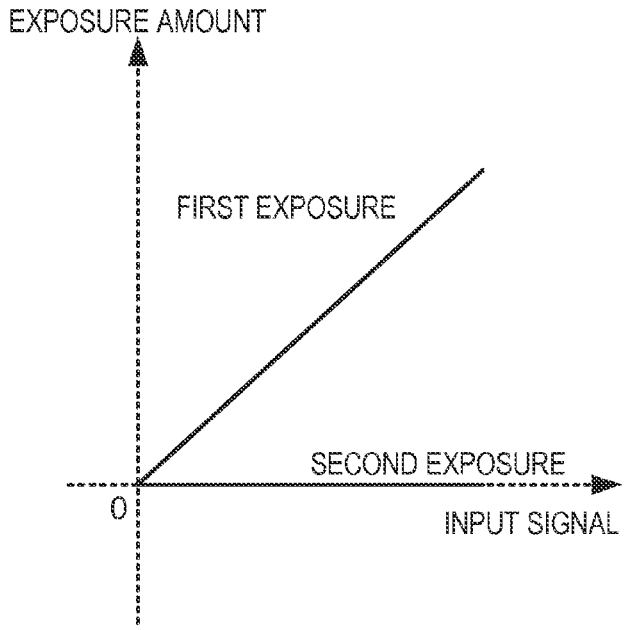
FIGS. 7A and 7B are graphs showing an exposure characteristic according to an embodiment.
Figure 7B:
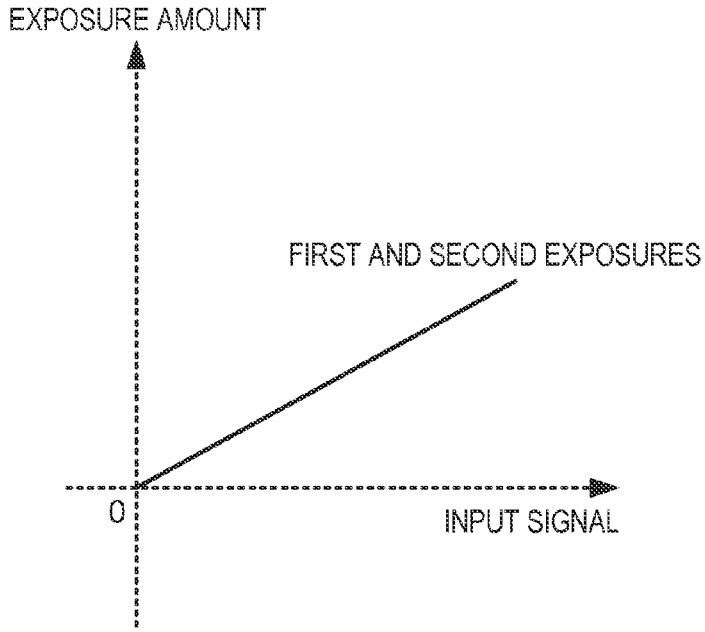

In this embodiment, the exposure characteristic in each cycle of the multiple exposure is changed by the image type determined from the attribute information of image data. More specifically, for an image portion whose type is "character image", a necessary electrostatic latent image is created by the first scan, and the light sources are prohibited from emitting light in the second scan, as shown in FIG. 7A. That is, the first scan is performed in an exposure amount necessary for forming the electrostatic latent image. On the other hand, for an image portion whose type is "halftone image", an electrostatic latent image is formed by two exposure processes to suppress generation of stripes in the rotational direction of the photosensitive member and reduce unevenness in the image density caused in the rotational direction of the photosensitive member. More specifically, the exposure amount of the first scan and that of the second scan are made to almost equal, and a necessary exposure amount is obtained in total, as shown in FIG. 7B. Note that in FIGS. 7A and 7B, the exposure amount is determined by luminance modulation. However, PWM (Pulse Width Modulation) is also usable.

Figure 8A:
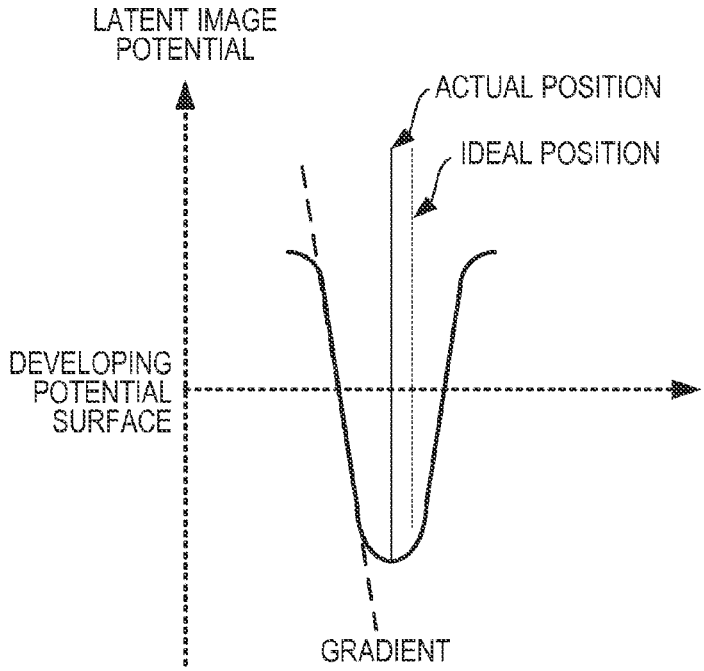
FIGS. 8A and 8B are explanatory views of a latent image profile on the surface of a photosensitive member according to an embodiment.
Figure 8B:
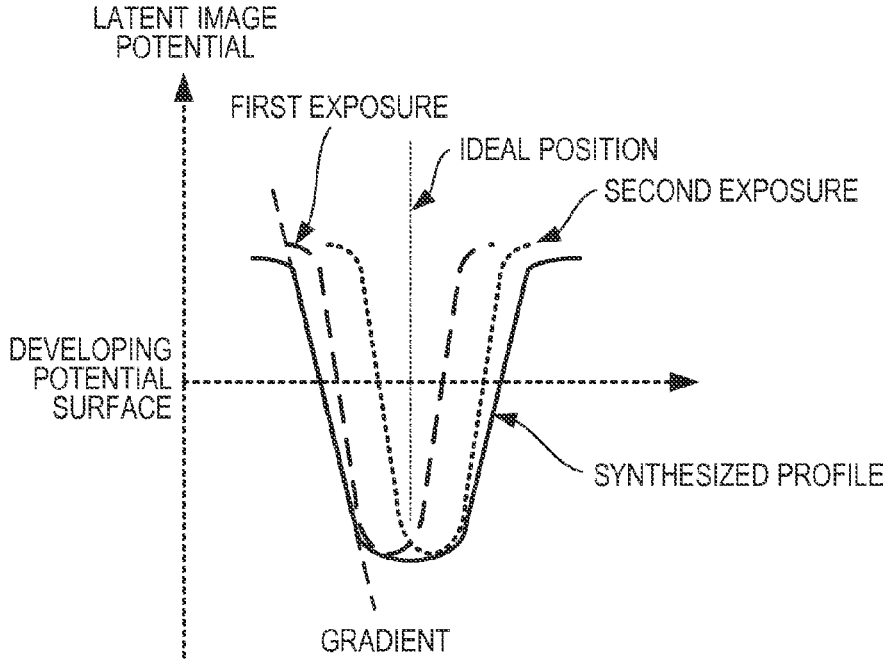

Note that the light power of the light beam when forming a character image is twice the light power of the light beam in each scan when forming a halftone image. FIGS. 8A and 8B show 1-pixel electrostatic latent images when forming a character image and a halftone image, respectively. Note that it is difficult to directly observe the profile of an electrostatic latent image, and FIGS. 8A and 8B show results obtained by a simulation based on the exposure profile, charge carrier generation, and the transportation process thereof in the photosensitive member. FIG. 8A shows a latent image profile for a pixel of a character image formed by one exposure. FIG. 8B shows latent image profiles obtained for a given pixel by two exposure processes and a synthesized profile generated by synthesizing the profiles. Note that the ideal position means a target position to be irradiated with the center of a light beam, that is, a pixel forming position, and the actual position means a position actually irradiated with the center of the light beam. The positional shift amount between the ideal position and the actual position is about 10 μm or less from an experimental result. In this simulation, the shift between the ideal position and the actual position is 5 μm.

Figure 9:
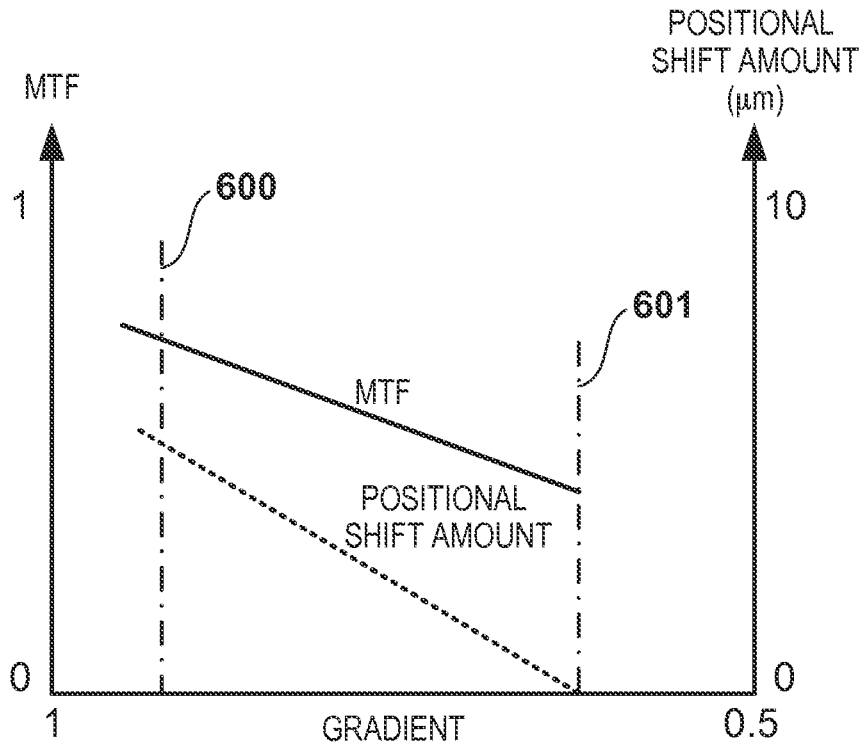
FIG. 9 is a graph showing the relationship between an output image and the gradient of the latent image profile on a developing potential surface.

As shown in FIG. 8B, in multiple exposure, the range of the synthesized latent image widens due to the positional shift in each scan. For this reason, the gradient of the latent image profile on the developing potential surface becomes small. FIG. 9 shows the relationship between the gradient of the latent image profile on the developing potential surface and the MTF (Modulation Transfer Function) and the positional shift amount between the ideal position and the actual position of the output image. Note that the MTF represents the resolution of an image. As the MTF becomes closer to 1, the sharpness increases. That is, the higher the MTF is, the higher the sharpness of the output image is. If the positional shift amount of the irradiation position increases, periodical stripes or unevenness occurs. Referring to FIG. 9, reference numeral 600 represents the gradient of the latent image profile on the developing potential surface in one exposure, and reference numeral 601 represents the gradient of the latent image profile on the developing potential surface in two exposure processes. As is apparent from FIG. 9, the character image whose electrostatic latent image is formed by one exposure has a larger positional shift amount and a higher sharpness as compared to a halftone image whose electrostatic latent image is formed by two exposure processes.

Figure 10A:
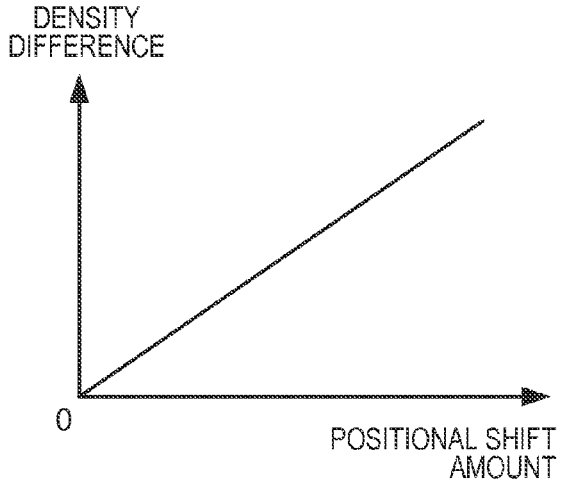
FIGS. 10A to 10C are explanatory views of the relationship between a positional shift amount and an image density.
Figure 10B:
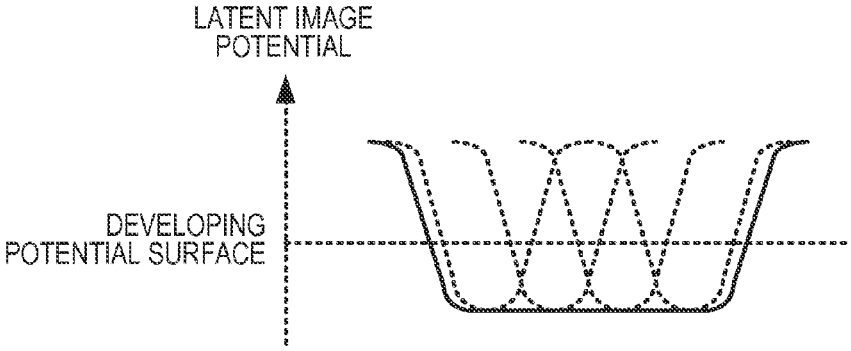
Figure 10C:
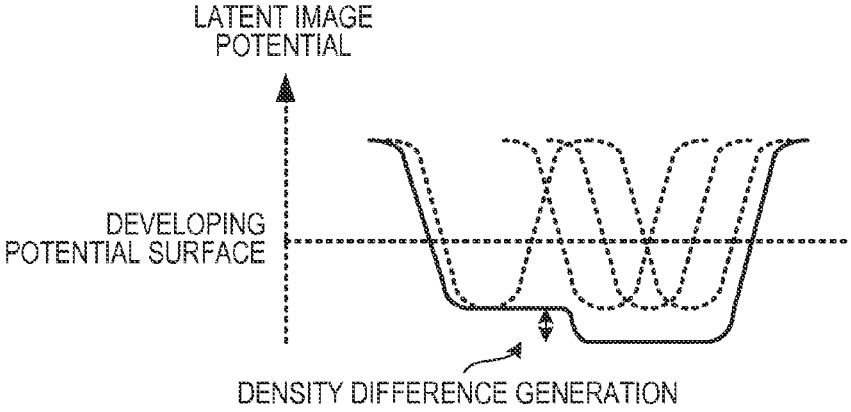

FIGS. 10B and 10C are views showing the latent image profile and the synthesized profile in each scan. Note that FIG. 10B shows a case in which the interval between the latent image profiles is relatively equal, and FIG. 10C shows a case in which the interval between the latent image profiles is nonuniform, that is, a case in which positional shifts occur. Note that a dotted line indicates a latent image profile of each scan, and a solid line indicates a synthesized profile. As shown in FIG. 10C, when a positional shift occurs, a density difference is generated. As shown in FIG. 10A, the density difference becomes large as the positional shift amount increases. In multiple exposure, the density difference appears at the scan period of the plurality of light beams, and a stripe/uneven image is generated.

As described above, in this embodiment, for a character image whose latent image is formed by one scan process, a deep and narrow latent image is formed. Hence, an image having high sharpness can be output. On the other hand, for a halftone image, the latent image is formed by overlaying exposure processes of the respective cycles. Hence, the forming position becomes close to the ideal position, and stripes and unevenness caused by positional shifts can be reduced.

Figure 11:
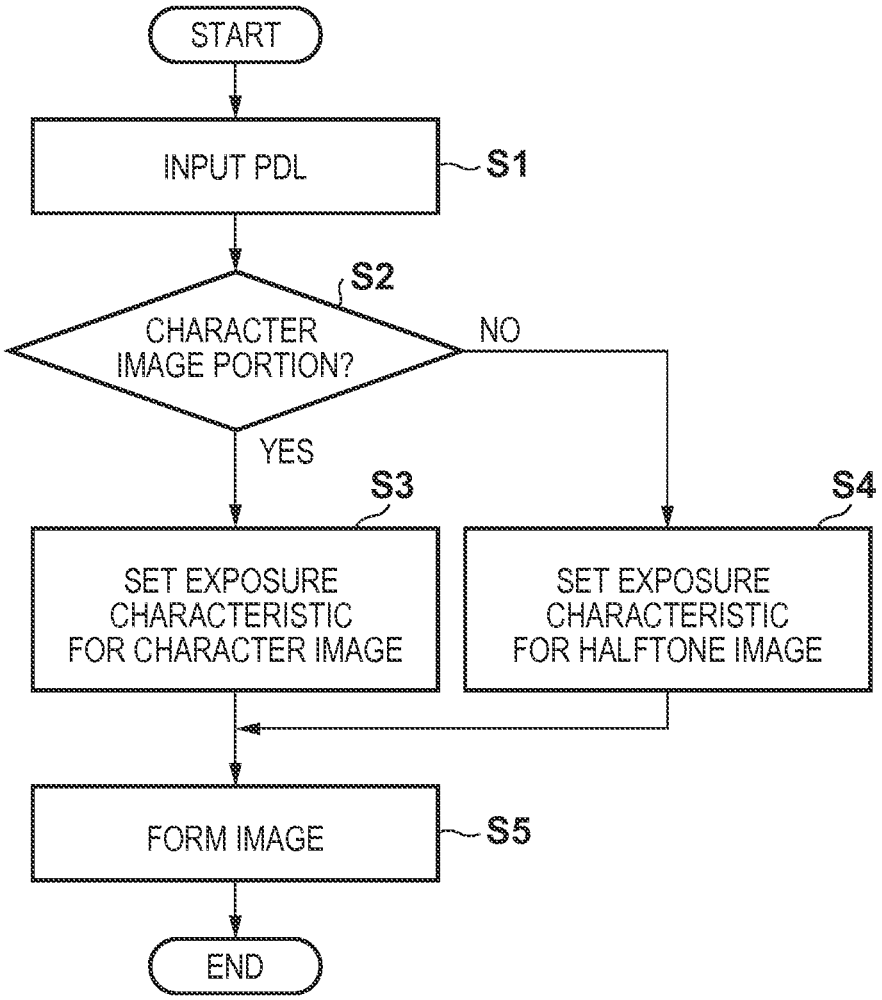
FIG. 11 is a flowchart of image formation processing according to an embodiment.

FIG. 11 is a flowchart of image formation processing executed by the image forming apparatus 100. When PDL data is received from the host apparatus 107 in step S1, the image processing unit 103 determines the type of each image portion in step S2. For a character image, the engine control unit 106 sets the exposure characteristic of the image forming unit 108 for the character image, as shown in FIG. 7A, in step S3. That is, the exposure amount is set to form an electrostatic latent image by one exposure. For a halftone image, the engine control unit 106 sets the exposure characteristic of the image forming unit 108 for the halftone image, as shown in FIG. 7B, in step S4. That is, the exposure amount is set to form an electrostatic latent image by exposure processes of the respective cycles using equal exposure amounts. After that, in step S5, the image forming unit 108 forms an electrostatic latent image by the set exposure characteristic and prints the image on a printing material.

As described above, according to this embodiment, for a character image that is readily affected by sharpness but hardly affected by stripes and unevenness because it is often constructed by a high-density line image, the latent image is formed by one exposure, thereby increasing the sharpness. On the other hand, for a halftone image such as an image/graphics that is hardly affected by sharpness but readily affected by stripes and unevenness because it is often constructed by a halftone or a halftone image, an image is formed while reducing the degradation in image quality caused in multiple exposure performed by scanning the photosensitive member by a plurality of light beams. This allows preventing the quality from lowering.

Second Embodiment

The charge amount of frictional electrification of the developing material of an image forming apparatus changes depending on the atmosphere. Hence, the latent image contrast potential necessary for the image forming apparatus in outputting the maximum density changes depending on the atmosphere of the place where the image forming apparatus is installed. More specifically, in an environment of high temperature and humidity where the water content in the atmosphere is large, the necessary latent image contrast potential is low. In an environment of low temperature and humidity where the water content in the atmosphere is small, the necessary latent image contrast potential is high. In the first embodiment, the electrostatic latent image of a character image is formed by one scan. However, providing a light source having a maximum output capable of ensuring the necessary latent image contrast potential by one scan in any environment may be problematic in terms of cost and technique. In the second embodiment, the latent image contrast potential necessary at the time of image formation is determined based on the atmosphere, and multiple exposure is performed even for a character image depending on the determined latent image contrast potential. Note that the formation of the electrostatic latent image of a halftone image is the same as in the first embodiment.

Figure 12A:
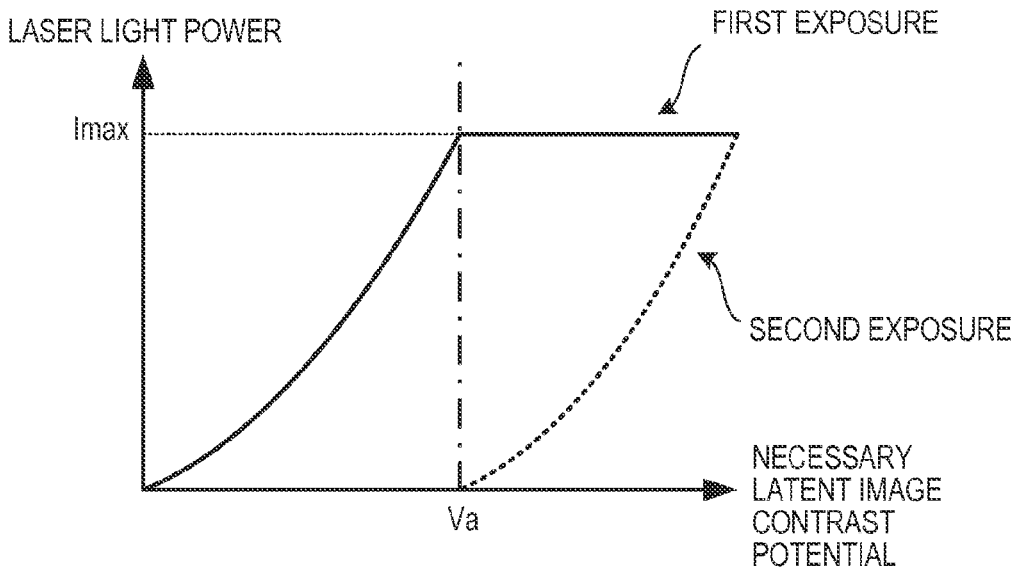
FIGS. 12A and 12B are explanatory views of exposure of a character image according to an embodiment.
Figure 12B:
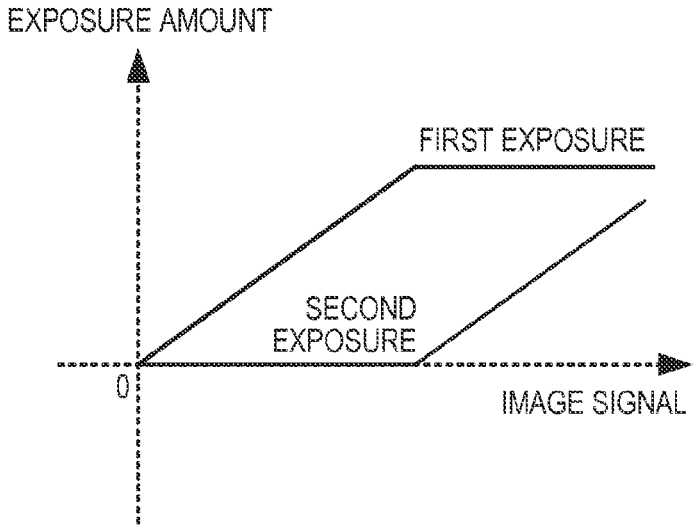

FIG. 12A shows the relationship between the electrostatic latent image necessary when forming a character image and the light beam amount in each scan. Note that Imax is the maximum light power of the light source in use, and Va is the latent image contrast potential at this time. Hence, if the necessary latent image contrast potential is equal to or lower than Va, the necessary latent image contrast potential Va can be ensured by one exposure (first exposure), and the laser output is set to 0 in the second exposure. However, if the necessary latent image contrast potential is higher than Va, the scan is performed using the maximum usable light power Imax of the light beam in the first exposure. In the second exposure (second exposure), the scan is performed using the light power of the light beam that compensates for the shortage in the first exposure. FIG. 12B shows the relationship between the exposure amount and an image signal modulated by PWM. As shown in FIG. 12B, if the necessary latent image contrast potential cannot be obtained by one exposure, the first exposure is done using the maximum light power, and an exposure amount corresponding to the shortage is obtained in the second exposure.

Figure 13:
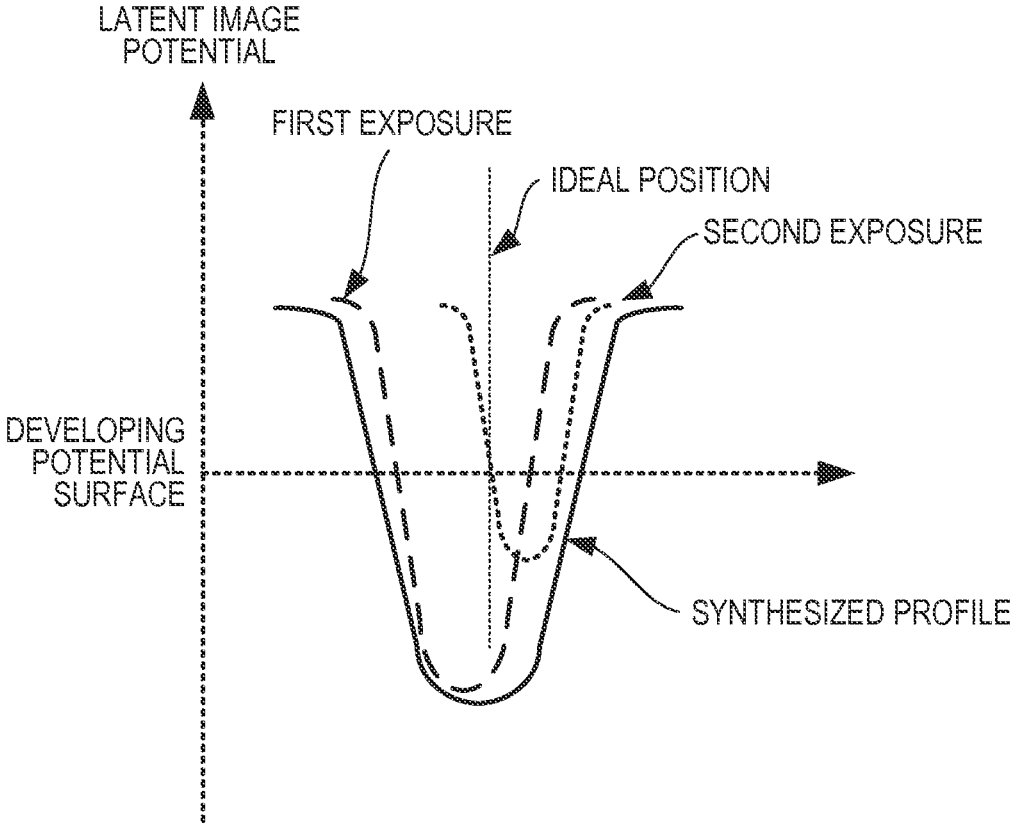
FIG. 13 is a graph showing the latent image profile of a character image according to an embodiment.

FIG. 13 is a graph showing the latent image profile of a pixel of a character image according to this embodiment. In exposure of the first scan, a deep and sharp latent image can be formed, although there exists an error with respect to the ideal latent image forming position. The synthesized profile in the second scan is wider than the profile obtained by the first scan. However, the light power of the light beam in the second scan is generally lower than that in the first scan, and the sharpness is improved as compared to a case in which exposure is performed twice using the same light power. As described above, in this embodiment, the difference between the exposure amount in the first scan and that in the second scan when forming a character image is made larger than the difference between the exposure amount in the first scan and that in the second scan when forming a halftone image. In other words, the ratio of the exposure amount in the first scan to the exposure amount in the second scan when forming a halftone image is set to almost 1. The ratio of the exposure amount in the first scan to the exposure amount in the second scan when forming a character image is set to be higher than the ratio for the halftone image. This arrangement allows preventing the degradation in sharpness of a character image. Note that in the embodiment, the second exposure is performed to compensate for the shortage in the exposure amount for ensuring the necessary latent image contrast potential. That is, the exposure amount in the first scan when forming a character image is equal to or larger than the exposure amount in the second scan. However, the second exposure may be done using the maximum light power of the light beam, and the first exposure may be done using the light power of the light beam for compensating for the shortage.

Figure 14:
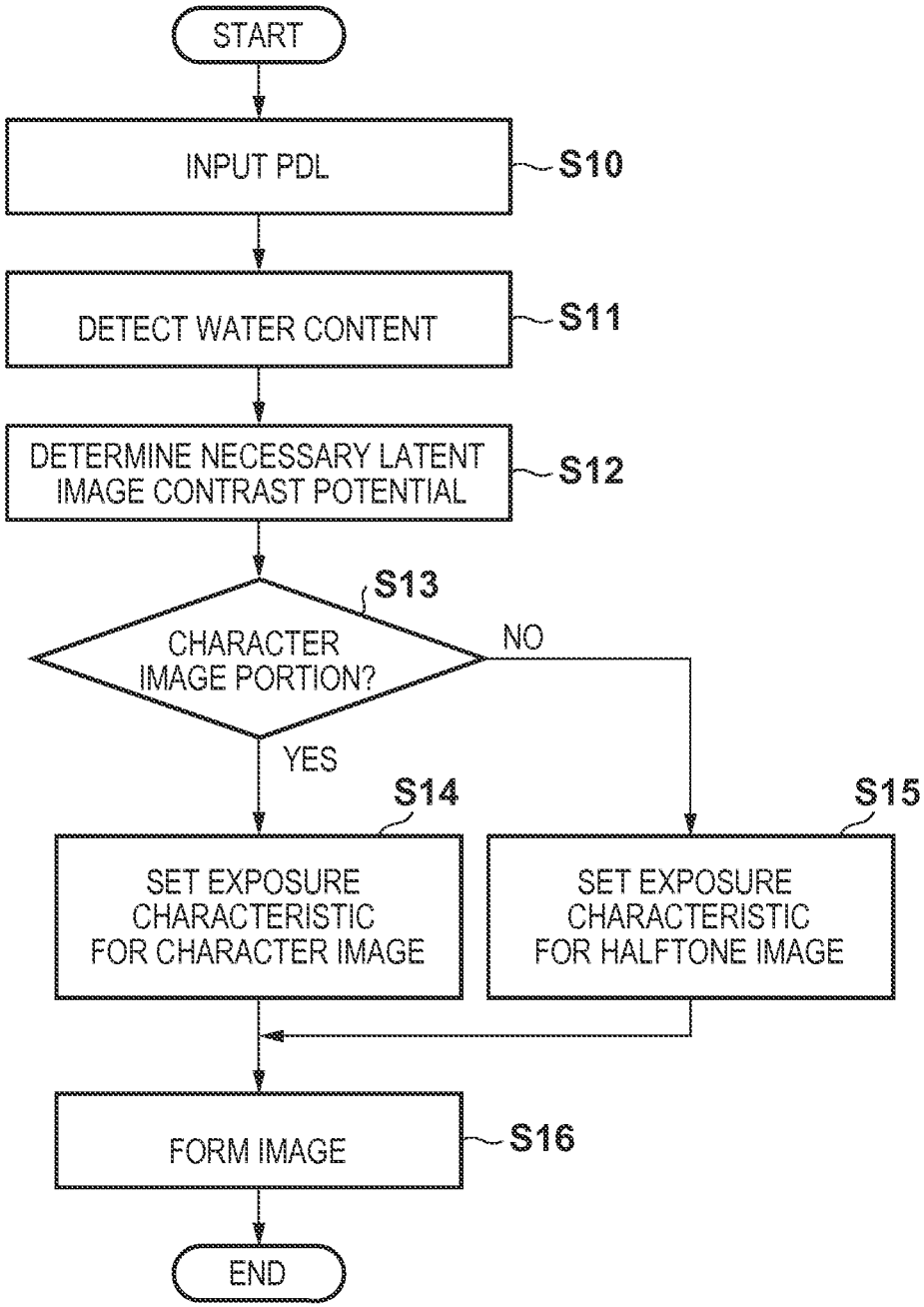
FIG. 14 is a flowchart of image formation processing according to an embodiment.

FIG. 14 is a flowchart of image formation processing executed by an image forming apparatus 100 according to this embodiment. When PDL data is received from a host apparatus 107 in step S10, an engine control unit 106 detects the ambient state, that is, the water content in the atmospheric environment in this embodiment from the value of an ambient sensor in step S11. In step S12, the engine control unit determines the necessary latent image contrast potential from the detected water content. After that, in step S13, an image processing unit 103 determines the type of the image. For a character image, the engine control unit 106 sets the exposure characteristic of an image forming unit 108 for the character image, as shown in FIG. 12A or 12B, in step S14. That is, if the latent image contrast potential determined in step S12 can be ensured by one exposure, an exposure amount to obtain the latent image contrast potential is set. On the other hand, if the latent image contrast potential determined in step S12 cannot be ensured by one exposure, an exposure amount for each of two exposure processes is set to obtain the latent image contrast potential. Note that the difference between the exposure amounts of the respective exposure processes is maximized at this time. For a halftone image, the engine control unit 106 sets the exposure characteristic of the image forming unit 108 for the halftone image, as shown in FIG. 7B, in step S15. After that, in step S16, the image forming unit 108 forms an electrostatic latent image by the set exposure characteristic and prints the image on a printing material. Note that the necessary latent image contrast potential may be determined based on an ambient state other than the water content in the atmosphere.

Figure 15:
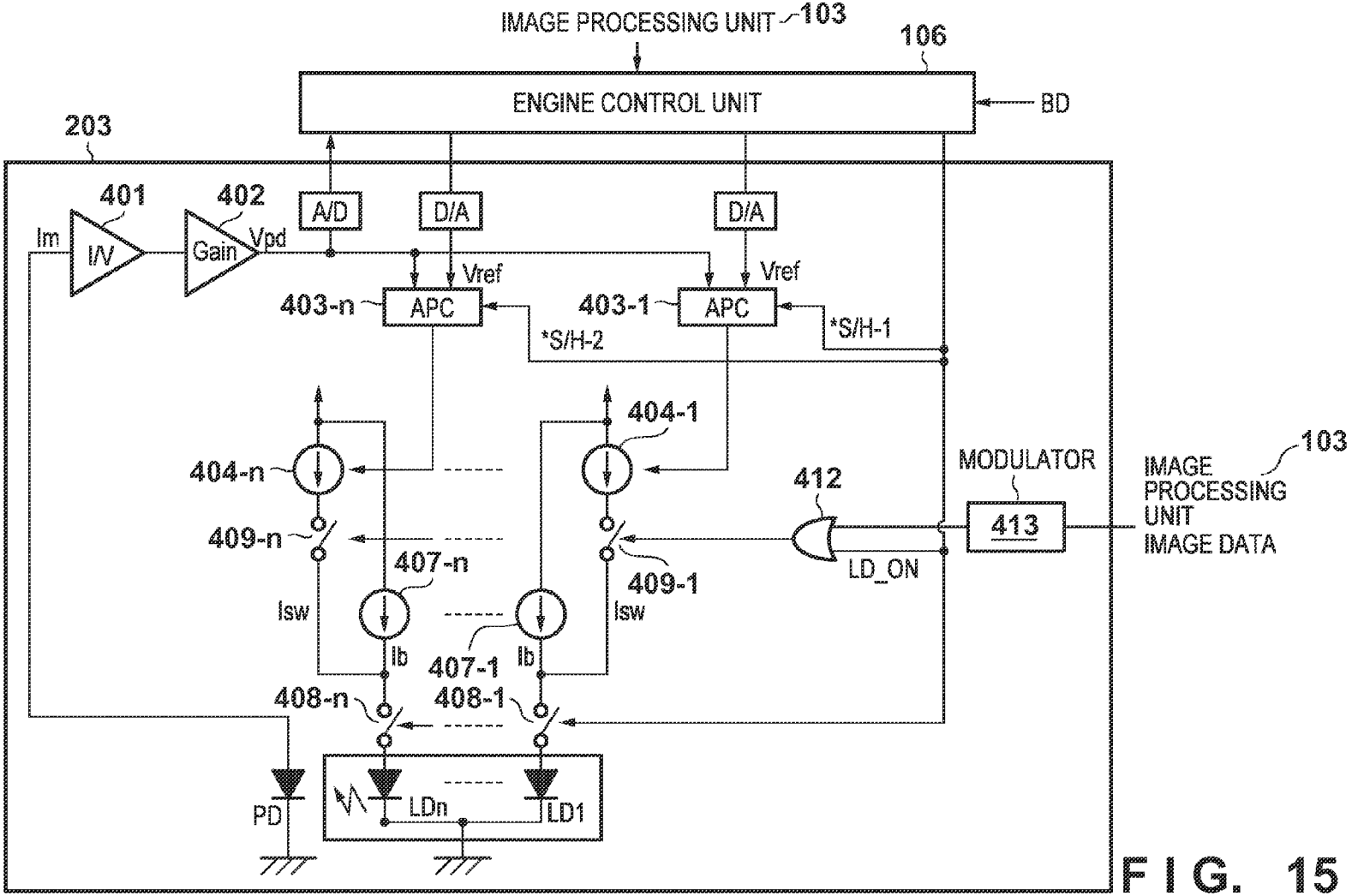
FIG. 15 is an explanatory view of light power control of the light source unit.

Control of the light power of a light source unit 10 in an exposure unit 203 will be described next with reference to FIG. 15. The exposure unit 203 shown in FIG. 15 includes a plurality of (n) laser diodes (LD1 to LDn). A bias current source 407-1 and a switching current source 404-1 are connected to the LD1. The bias current source 407-1 supplies a bias current to the LD1. The light emission response of the LD1 when supplying a switching current to be described below can be increased by supplying the bias current.

The switching current source 404-1 supplies a switching current to the LD1 in accordance with image data. The exposure unit 203 includes a modulator 413. The image processing unit 103 inputs image data to the modulator 413. The image data is binary image data converted from multilevel image data. The binary image data is modulated into a pulse signal by the modulator 413, and the pulse signal is output to a logical element 412.

The engine control unit 106 inputs, to the logical element 412, an enable signal (LD_ON signal) that permits exposure of the photosensitive member. The LD_ON signal is also input to a switch element 408-1. In accordance with signal input from the image processing unit 103 to the engine control unit 106, the engine control unit 106 outputs the LD_ON signal to the logical element 412 and the switch element 408-1. The logical element 412 outputs the OR of the pulse signal and the LD_ON signal to a switch element 409-1. More specifically, when a signal of H level (High level) is input to the logical element 412 in a state in which the LD_ON signal is output from the engine control unit 106, the switch element 409-1 is turned on. The LD1 thus receives the switching current supplied from the switching current source 404-1 and the bias current supplied from the bias current source 407-1. On the other hand, when a signal of L level (Low level) is input to the logical element 412 in the state in which the LD_ON signal is output from the engine control unit 106, the switch element 409-1 is turned off. The LD1 thus receives the bias current supplied from the bias current source 407-1 without receiving the switching current supplied from the switching current source 404-1. That is, when forming a pixel on the photosensitive member, the PWM signal changes to H level, and the LD1 accordingly emits a light beam of a light power for changing the surface potential of the photosensitive member. If no pixel is to be formed on the photosensitive member, the PWM signal changes to L level, and no switching current is supplied to the LD1. Note that when only the bias current is supplied, the light beam emitted by the LD1 has a light power not to change the surface potential of the photosensitive member. Note that the modulator 413 and the logical element 412 are individually provided for each of the LD1 to LDn, and the light emission control is executed even for the LDn in the same way.

Light power control (Automatic Power Control: to be referred to as APC hereinafter) executed during image formation will be described next by exemplifying the LD1. APC is control to adjust the light power of a light beam to scan the surface of the photosensitive member to the target light power. As shown in FIG. 15, the image forming apparatus includes one photodiode (PD) that receives light beams emitted by the LD1 to LDn. The PD outputs a current Im corresponding to the detected light power to a current/voltage converter 401. The current/voltage converter 401 converts the received current Im into a voltage and outputs it. An amplifier 402 is used to adjust the gain of the voltage output from the current/voltage converter 401. The voltage for which the gain of the output from the PD that has detected the light beam from the LD1 has been adjusted by the amplifier 402 is given to an APC circuit 403-1 as a light power monitor voltage Vpd. The engine control unit 106 outputs a sample/hold signal S/H to one of the APC circuits 403-1 to **403-*n*. The APC circuit that has received the sample/hold signal S/H executes the APC. The PD, the current/voltage converter 401, and the amplifier 402** function as a detection unit that detects the light power of the light beam output from the LD1.

The APC is executed for each light-emitting element when the light beam is scanning a non-image region that is a region other than the image forming region on the photosensitive member. In the non-image region, the engine control unit 106 outputs the LD_ON signal, and the modulator 413 supplies a pulse signal of H level to the logical element 412. The switch element 409-1 is thus turned on, the bias current and the switching current are supplied to the LD1, and the LD1 emits light. The light beam from the LD1 enters the PD, and the light beam of the LD1 is detected as the light power monitor voltage Vpd by the above-described arrangement. The APC circuit 403-1 compares Vpd corresponding to the light beam of the LD1 with Vref output from the engine control unit 106. If the comparison result is Vpd>Vref, the APC circuit 403-1 controls the switching current source 404-1 based on the difference between Vpd and Vref so as to make the current value of the switching current to be supplied to the LD1 smaller than the presently set current value. If the comparison result is Vpd<Vref, the APC circuit 403-1 controls the switching current source 404-1 based on the difference between Vpd and Vref so as to make the current value of the switching current to be supplied to the LD1 larger than the presently set switching current value. The switching current having the value set here is supplied to the LD1 when emitting the light beam to scan the immediately subsequent image forming region. An example in which the switching current is set has been described above. However, the current value of the bias current may also be set based on the PD detection result.

Light power control corresponding to the image type, which is executed by the above-described arrangement, will be described next. The image processing unit 103 transmits a signal concerning the image type to the engine control unit 106. That is, if the image (or pixel) to be formed by the image processing unit 103 is determined as a character, the image processing unit 103 transmits a signal representing that the image type is "character" to the engine control unit 106. The engine control unit 106 controls Vref to a value Vc corresponding to the character image. On the other hand, if the image (or pixel) to be formed by the image processing unit 103 is determined as a picture, the image processing unit 103 transmits a signal representing that the image type is "picture" to the engine control unit 106. The engine control unit controls Vref to a value Vp corresponding to the picture image.

This will be described in more detail by exemplifying a case in which the LD1 shown in FIG. 15 performs the first exposure, and the LDn performs the second exposure. When forming a character image, the engine control unit 106 controls Vref to be output to the APC circuit 403-1 to Vp1 and Vref to be output to the APC circuit **403-*n* to Vcn. When forming a picture image, the engine control unit 106 controls Vref to be output to the APC circuit 403-1 to Vp1 and Vref to be output to the APC circuit 403-*n*** to Vpn. At this time, since Vref is a value corresponding to the light power, $$|Vc1-Vcn|>|Vp1-Vpn|$$

holds in the image forming apparatus of this embodiment.

In this way, the value of Vref to be input to the APC circuit is changed in accordance with the image type, thereby exposing the photosensitive member by the light power corresponding to the image type.

As described above, according to this embodiment, a high-quality output can be attained in accordance with the output environment condition without incorporating a high-power light source. In the above-described embodiments, a VCSEL is used as the light source. However, the light source unit 10 including a plurality of arbitrary light sources, for example, an LED array is also usable.

In the above-described embodiments, a character image is classified as "character", and an image other than the character image is classified as "halftone". However, if an image portion for which the attribute information of PDL data is "graphic" is mainly formed from only lines, the image type can be determined not as "halftone" but as "character". That is, not only a character image but also a line image whose quality is readily affected by the degradation in sharpness can be classified as the same type as the character image and exposed like the character image.

In the above-described embodiments, multiple exposure is performed by two scan processes. However, the present invention is also applicable to a case in which the multiple exposure is performed N times (N is an integer equal to or larger than 2) for each scan line. In this case, when forming a pixel of a halftone image, the engine control unit 106 forms the electrostatic latent image by performing exposure N times. At this time, the engine control unit 106 controls the image forming unit such that the exposure amounts for each pixel becomes almost uniform. On the other hand, when forming a pixel of a character image, the engine control unit 106 obtains, based on the maximum light power of the light source to be used, the minimum exposure count that is equal to or smaller than N and is enough to ensure the latent image contrast necessary for forming the pixel, and controls to form one pixel by performing exposure as many times as the obtained count.

Other Embodiments

Aspects of the present invention can also be realized by a computer of a system or apparatus (or devices such as a CPU or MPU) that reads out and executes a program recorded on a memory device to perform the functions of the above-described embodiments, and by a method, the steps of which are performed by a computer of a system or apparatus by, for example, reading out and executing a program recorded on a memory device to perform the functions of the above-described embodiments. For this purpose, the program is provided to the computer for example via a network or from a recording medium of various types serving as the memory device (for example, computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-027723, filed on Feb. 10, 2012 which is hereby incorporated by reference herein in its entirety.

What is claimed is:

1. An image forming apparatus for forming an image based on image data, comprising:

a photosensitive member;

an exposure unit configured to perform, based on the image data, first exposure for said photosensitive member and second exposure for said photosensitive member exposed by the first exposure, one pixel included in an image being formed by the first exposure and the second exposure;

a determination unit configured to determine whether an image to be formed is a first type or a second type based on the image data, a pixel included in an image of the first type being sharper than a pixel included in an image of the second type; and a control unit configured to control said exposure unit such that a difference in an exposure amount between the first exposure and the second exposure when forming the image of the first type is larger than a difference in an exposure amount between the first exposure and the second exposure when forming the image of the second type.

2. The apparatus according to claim 1, wherein said control unit is further configured to determine a latent image contrast necessary for forming the image from an ambient state at the time of image formation.

3. The apparatus according to claim 1, wherein the image of the first type includes character, and the image of the second type includes picture.

4. The apparatus according to claim 3, wherein said determination unit is further configured to determine the type of the image based on a command of a page description language.

5. The apparatus according to claim 4, wherein said determination unit is further configured to determine the type of the image described by a character code of the page description language as the character.

6. The apparatus according to claim 4, wherein said determination unit is further configured to determine the type of the image described by a character code and a graphic code of the page description language as the character.

* * * * *